US005273671A

United States Patent [19]

Patil et al.

[11] Patent Number: 5,273,671

[45] Date of Patent: Dec. 28, 1993

[54] MULTIFUNCTIONAL VISCOSITY INDEX IMPROVER-DISPERSANT ANTIOXIDANT

[75] Inventors: Abhimanyu O. Patil, Westfield; Robert D. Lundberg, Bridgewater, both of N.J.

[73] Assignee: Exxon Chemical Patents Inc., Linden, N.J.

[21] Appl. No.: 18,965

[22] Filed: Feb. 18, 1993

Related U.S. Application Data

[60] Division of Ser. No. 919,635, Jul. 24, 1992, Pat. No. 5,211,865, which is a continuation of Ser. No. 490,802, Mar. 8, 1990, abandoned.

[51] Int. Cl.[5] ..... C10M 149/10

[52] U.S. Cl. ..... 252/51.5 A; 252/56 D; 525/375; 525/376

[58] Field of Search ..... 252/51.5; 525/375, 376

[56] References Cited

U.S. PATENT DOCUMENTS

| | | | |
|---|---|---|---|
| 3,316,177 | 4/1967 | Dorer, Jr. | 252/51.5 |
| 3,326,804 | 6/1967 | Hu | 252/34 |
| 3,632,600 | 1/1972 | Morris | 252/51.5 A |
| 3,788,993 | 1/1974 | Andress, Jr. | 252/51.5 A |
| 3,846,318 | 11/1974 | Lowe | 252/47.5 |
| 3,884,932 | 5/1975 | Andress, Jr. | 260/308 B |
| 3,897,351 | 7/1975 | Davis et al. | 252/34 |
| 4,089,794 | 5/1978 | Engel et al. | 252/51.5 A |
| 4,132,661 | 1/1979 | Waldbillig et al. | 252/51.5 A |
| 4,137,185 | 1/1979 | Gardiner et al. | 252/33 |
| 4,144,181 | 3/1979 | Elliott et al. | 252/33 |
| 4,148,605 | 4/1979 | Andress, Jr. | 422/7 |
| 4,153,564 | 5/1979 | Chibnik | 252/51.5 A |
| 4,160,739 | 7/1979 | Stambaugh et al. | 252/34 |
| 4,169,063 | 9/1979 | Kiovsky | 252/51.5 A |
| 4,171,273 | 10/1979 | Waldbillig et al. | 252/51.5 A |
| 4,212,754 | 7/1980 | Chibnik | 252/49.7 |
| 4,219,432 | 8/1980 | Girgenti et al. | 252/51.5 A |
| 4,320,019 | 3/1982 | Hayashi | 252/51.5 A |
| 4,517,104 | 5/1985 | Bloch et al. | 252/51.5 A |
| 4,734,209 | 3/1988 | Phillips et al. | 252/47 |
| 4,820,776 | 4/1989 | Kapuscinski et al. | 525/279 |
| 4,855,074 | 8/1989 | Papay et al. | 252/51.5 A |
| 4,859,355 | 8/1989 | Chibnik | 252/47.5 |
| 4,897,086 | 1/1990 | Blain et al. | 44/53 |
| 4,963,278 | 10/1990 | Blain et al. | 252/51.5 A |
| 4,994,197 | 2/1991 | Blain et al. | 252/51.5 A |
| 5,210,146 | 5/1993 | Gutierrez et al. | 252/51.5 A |
| 5,211,865 | 5/1993 | Patil et al. | 252/56 D |
| 5,219,480 | 6/1993 | Gutierrez et al. | 252/51.5 A |

FOREIGN PATENT DOCUMENTS

| | | |
|---|---|---|
| 0871427 | 4/1979 | Belgium . |
| 0295854 | 12/1988 | European Pat. Off. . |
| 0352070 | 1/1990 | European Pat. Off. . |
| 0352072 | 1/1990 | European Pat. Off. . |
| 0357215 | 3/1990 | European Pat. Off. . |
| 84021918 | 10/1975 | Japan . |
| 58052393 | 9/1981 | Japan . |
| 59-189195 | 4/1983 | Japan . |
| 60-194087 | 3/1984 | Japan . |
| 1061904 | 3/1967 | United Kingdom . |
| 1514359 | 6/1978 | United Kingdom . |
| 1578049 | 10/1980 | United Kingdom . |
| 2055852 | 3/1981 | United Kingdom . |
| 2069505 | 8/1981 | United Kingdom . |
| 2071139 | 9/1981 | United Kingdom . |

*Primary Examiner*—Ellen M. McAvoy

*Attorney, Agent, or Firm*—J. B. Murray, Jr.; T. V. Kowalchyn

[57] ABSTRACT

Oleaginous compositions, particularly lubricating oil compositions, exhibiting improved antioxidant properties containing a viscosity index improving amount of a viscosity index improver-dispersant comprised of the reaction products of:

(a) an oil soluble ethylene copolymer comprising from about 15 to 90 wt. % ethylene and from about 10 to 85 wt. % of at least one $C_3$ to $C_{28}$ alpha-olefin, having a number average molecular weight of from about 5,000 to 500,000, grafted with an ethylenically unsaturated carboxylic acid material having 1 or 2 acid or anhydride moieties;

(b) an organic polyamine having at least two primary amino groups;

(c) an aldehyde;

(d) a heterocyclic nitrogen reactant having at least one —N (H)— group in the heterocyclic ring; and, optionally, (e) an amount effective to provide a V.I. improver-dispersant exhibiting improved low temperature viscometric properties of high functionality long chain hydrocarbyl substituted dicarboxylic acid material having a functionality of at least 1.2.

45 Claims, No Drawings

MULTIFUNCTIONAL VISCOSITY INDEX IMPROVER-DISPERSANT ANTIOXIDANT

CROSS REFERENCE OF RELATED CASES

This is a division of application Ser. No. 07/919,635, filed Jul. 24, 1992, now U.S. Pat. No. 5,211,865, which is a R62C of U.S. Ser. No. 490,802, filed Mar. 8, 1990, abandoned Jul. 24, 1992.

BACKGROUND OF THE INVENTION

The concept of derivatizing viscosity index (V.I.) improving high molecular weight ethylene copolymers with acid moieties such as maleic anhydride, followed by reaction with an amine or polyol to form a V.I.-dispersant oil additive is known in the art and is described in the patent literature. This concept is described, for example, in the following patents: U.S. Pat. Nos. 3,316,177; 3,326,804; 4,089,794; 4,132,661; 4,137,185; 4,144,181; 4,160,739; 4,169,063; 4,171,273; 4,219,432; 4,517,104; French published application no. 2423530; German published application nos. P3025274.5; 2753569.9; and 2845288;

U.S. Pat. No. 3,632,600 relates to aliphatic-hydrocarbyl substituted heterocyclic nitrogen compounds useful as detergents and antioxidants for lubricant and fuel compositions, there being attached to a carbon atom or to a nitrogen atom of the heterocyclic ring a hydrocarbyl group having about 20–150 carbon atoms. The preparation of N-polyisobutenyl pyrrole, N-polyisobutenyl pyrazole and N-polyisobutenyl benzotriazole (from polyisobutenyl chloride and the corresponding heterocyclic compound, pyrrole, pyrazole and benzotriazole, respectively) is described.

U.S. Pat. Nos. 3,788,993 and 3,884,932 relate to hydrocarbon lubricant compositions containing the reaction product of an alkyl or alkenyl succinic anhydride and a benzotriazole or substituted benzotriazole which are reacted in mole ratios of from 1:1 to 1:2.

U.S. Pat. No. 3,846,318 relates to lubricating oil additives produced by the reaction of mercaptobenzothiazole, an aldehyde and a phenol, which may be alkylated with a $C_1$–$C_{24}$ alkyl group.

U.S. Pat. No. 3,897,351 relates to lubricant compositions containing an amine salt of the reaction product of an alkyl or alkenyl succinic anhydride and a benzotriazole or substituted benzotriazoles (employed in the mole ratio of from 1:1 to 1:2).

U.S. Pat. No. 4,148,605 relates to rust/corrosion inhibitors prepared by condensing a $C_8$ to $C_{28}$ alkenyl succinic anhydride with a $C_2$ to $C_{18}$ aliphatic hydroxy acid to form an ester-acid which can then be converted to amine salts. Suitable amines include triazoles such as benzotriazole and tolyl triazole.

U.S. Pat. No. 4,153,564 relates to additives for lubricants for fuels prepared by the reaction of an aromatic triazole, aldehyde and a product formed from alkenyl succinic anhydrides or acids and aniline-aldehyde resins. The product is disclosed to be characterized by —$CH_2$-triazole moieties as substituents to the aromatic groups of the aniline-aldehyde resin chains.

U.S. Pat. No. 4,212,754 relates to detergent and antiwear metal chelates prepared by (1) reacting a benzotriazole with a monoepoxide, (2) reacting the resulting hydroxyalkyl benzotriazole with an alkenyl succinic anhydride to form a monoester, and (3) converting the monoester to the salt of a metal which can form Werner complexes and complexing with a ligand-containing amine, hydroxyl, oxazoline or imidazoline groups to form the chelate.

U.S. Pat. No. 4,734,209 relates to metal deactivators formed by reaction between a triazole, formaldehyde and certain hydrocarbyl amines.

U.S. Pat. No. 4,820,776 relates to fuel oils and lubricants having improved properties containing ethylene-propylene copolymer bearing units derived from N-vinyl pyrrolidone and a second functional monomer which can comprise phenothiazines, imidazoles, benzimidazoles, thiazoles, benzothiazoles, triazoles, benzotriazoles, thiadiazoles, and other heterocyclic materials.

U.S. Pat. No. 4,855,074 relates to homogeneous additive concentrates useful in lubricating oils formed by heating a long chain succinimide and a benzotriazole in the presence of water, alkoxylated amines, dihydrocarbyl phosphites or dihydrocarbyl phosphites, and optionally also in the presence of a boronating agent and distilling the volatile components from the product.

U.S. Pat. No. 4,859,355 relates to a lubricant additive made by reacting a preformed Mannich base (prepared from a phenol, a $C_1$–$C_8$ alkyl aldehyde and a lower boiling point amine) in a displacement reaction with a reactive hydrocarbyl amine, thiol or dithiophosphoric acid having at least one reactive hydrogen. Amines suitable in the preformed Mannich base or in the displacement reaction are indicated to include benzotriazole and tolyltriazole.

U.K. Patent 1,061,904 relates to additives for lubricating compositions or hydraulic fluids prepared by reacting an imidazole or triazole with formaldehyde and a secondary mono-amine.

U.K. Patent 1,514,359 relates to additives for functional fluids prepared by reacting a monoamine, aldehyde and a compound which can comprise an alkaline-, cycloalkaline-, carbonyl-, sulphuryl-, —O—or —S—-linked benzotriazole or benzimidazole. The monoamines are disclosed to include primary and secondary alkyl or alkenyl-substituted monoamines wherein the alkyl or alkenyl group has from 2–20 carbon atoms.

U.K. Patent Publication 2,069,505 relates to benzotriazole compositions prepared by reacting a benzotriazole and a water-insoluble aliphatic amine, of which tertiary alkyl primary amines and oil soluble basic nitrogen-containing dispersants (e.g., polyisobutenyl succinimides) are preferred.

U.K. Patent Publication 2,071,139 relates to sulfurized olefin compositions comprising (A) at least one benzotriazole or a benzotriazole-aliphatic amine reaction product and (B) a sulfurization product of at least one aliphatic or alicyclic $C_3$–$C_{30}$ olefinic compound. The benzotriazole-aliphatic amine reaction product can be derived by reacting a benzotriazole with primary, secondary or tertiary monoamines, with polyamine, or with an oil-soluble basic nitrogen-containing dispersant.

Japanese Patent Publications 58-52,393; 58-189,195; 60-194,087 disclose the preparation of additives for lubricating oils prepared by reacting an aldehyde, a monoamine and either benzotriazole or alkyl-substituted derivatives of benzotriazole.

Japanese Patent 84-021918 (87 Chem. Abs. 120403b) relates to lubricating oils with improved corrosion inhibiting properties containing alkenyl succinimides and benzotriazole.

SUMMARY OF THE INVENTION

The present invention is directed to multifunctional viscosity index improvers comprising the reaction products of (A) ethylene copolymers grafted with ethylenically unsaturated carboxylic acid moieties, (B) polyamines, (C) an aldehyde, (D) a heterocyclic reactant having at least one —N(H)— group in the heterocyclic ring, and, optionally, (E) a hydrocarbyl substituted dicarboxylic acid material. Oleaginous compositions containing these multifunctional viscosity index improvers, which also function as dispersants, exhibit improved viscosity stability over an extended period of time, and can further exhibit improved low temperature viscometric properties and antioxidancy properties.

DETAILED DESCRIPTION OF THE INVENTION

In accordance with the present invention there are provided oil soluble viscosity index improver-dispersant additives comprising the reaction products of (A) ethylene copolymers, such as copolymers of ethylene and propylene, grafted with ethylenically unsaturated carboxylic acid moieties, preferably maleic anhydride moieties; (B) polyamines having two or more primary amine groups; (C) an aldehyde; (D) a heterocyclic reactant having at least one —N(H)— group in the heterocyclic ring; and, optionally, (E) a $C_8$ to $C_{500}$ hydrocarbyl substituted dicarboxylic acid material, wherein the hydrocarbyl group preferably compriges a long chain hydrocarbyl group derived from a polyolefin, most preferably poly($C_4$ alkenyl), having from about 400 to about 10,000 number average molecular weight. The V.I. improver-dispersants of the instant invention containing the benzotriazole moieties when incorporated into oleaginous compositions such as lubricating oil compositions impart improved, (i.e., increased) storage stability, and improved antioxidant characteristics relative to similar conventional V.I.-dispersants.

ETHYLENE COPOLYMER

Oil soluble ethylene copolymers used in the invention generally will have a number average molecular weight ($\overline{M}_n$) of from above about 10,000 to about 500,000; preferably 15,000 to 200,000 and optimally from about 20,000 to 100,000. In general, polymers useful as viscosity index improvers (also herein referred to as "V.I. improvers") will be used. These V.I. improvers will generally have a narrow range of molecular weight, as determined by the ratio of weight-average molecular weight ($\overline{M}_w$) to number-average molecular weight ($\overline{M}_n$). Polymers having a $\overline{M}_w/\overline{M}_n$ of less than 10, preferably less than 7, and more preferably 4 or less are most desirable. As used herein ($\overline{M}_n$) and ($\overline{M}_w$) are measured by the well known techniques of vapor phase osmometry (VPO) , membrane osmometry and gel permeation chromatography. In general, polymers having a narrow range of molecular weight may be obtained by a choice of synthesis conditions such as choice of principal catalyst and cocatalyst combination, addition of hydrogen during the synthesis, etc. Post synthesis treatment such as extrusion at elevated temperature and under high shear through small orifices, mastication under elevated temperatures, thermal degradation, fractional precipitation from solution, etc., may also be used to obtain narrow ranges of desired molecular weights and to break down higher molecular weight polymer to different molecular weight grades for V.I. use.

These polymers are prepared from ethylene and ethylenically unsaturated hydrocarbons including cyclic, alicyclic and acyclic, containing from 3 to 28 carbons, e.g., 3 to 18 carbons. These ethylene copolymers may contain from 15 to 90 wt. % ethylene, preferably 30 to 80 wt. % of ethylene and 10 to 85 wt. %, preferably 20 to 70 wt. % of one or more $C_3$ to $C_{28}$, preferably $C_3$ to $C_{18}$ more preferably $C_3$ to $C_8$, alpha olefins. While not essential, such copolymers preferably have a degree of crystallinity of less than 25 wt. %, as determined by X-ray and differential scanning calorimetry. Copolymers of ethylene and propylene are most preferred. Other alpha-olefins suitable in place of propylene to form the copolymer, or to be used in combination with ethylene and propylene to form a terpolymer, tetrapolymer, etc., include 1-butene, 1-pentene, 1-hexene, 1-heptene, 1-octene, 1-nonene, 1-decene, etc.; also branched chain alpha-olefins, such as 4-methyl-1-pentene, 4-methyl-1-hexene, 4,4-dimethyl-1-pentene, and 6-methylheptene-1, etc., and mixtures thereof.

The term copolymer as used herein, unless otherwise indicated, includes terpolymers, tetrapolymers, etc., of ethylene, said $C_{3-28}$ alpha-olefin and/or a non-conjugated diolefin or mixtures of such diolefins which may also be used. The amount of the non-conjugated diolefin will generally range from about 0.5 to 20 mole percent, preferably about 1 to about 7 mole percent, based on the total amount of ethylene and alpha-olefin present.

Representative examples of non-conjugated dienes that may be used as the third monomer in the terpolymer include:

a. Straight chain acyclic dienes such as: 1,4-hexadiene; 1,5-heptadiene; 1,6-octadiene.
b. Branched chain acyclic dienes such as: 5-methyl-1,4-hexadiene; 3,7-dimethyl 1,6-octadiene; 3,7-dimethyl 1,7-octadiene; and the mixed isomers of dihydro-myrcene and dihydro-cymene.
c. Single ring alicyclic dienes such as: 1,4-cyclohexadiene; 1,5-cyclooctadiene; 1,5-cyclo-dodecadiene; 4-vinylcyclohexene; 1-allyl, 4-isopropylidene cyclohexane; 3-allyl-cyclopentene; 4-allyl cyclohexene and 1-isopropenyl-4-(4-butenyl) cyclohexane.
d. Multi-single ring alicyclic dienes such as: 4,4'-dicyclopentenyl and 4,4'-dicyclohexenyl dienes.
e. Multi-ring alicyclic fused and bridged ring dienes such as: tetrahydroindene; methyl tetrahydroindene; dicyclopentadiene; bicyclo (2.2.1)-hepta-2,5-diene; alkyl, alkenyl, alkylidene, cycloalkenyl and cycloalkylidene norbornenes such as: ethyl norbornene; 5-methylene-6-methyl-2-norbornene; 5-methylene-6, 6-dimethyl-2-norbornene; 5-propenyl-2-norbornene; 5-(3-cyclopentenyl)-norbornene and 5-cyclohexylidene-2-norbornene; norbornadiene; etc.

ETHYLENICALLY UNSATURATED CARBOXYLIC ACID MATERIAL

These materials which are grafted (attached) onto the ethylene copolymer contain at least one ethylenic bond and at least one, preferably two, carboxylic acid groups, or an anhydride group, or a polar group which is convertible into said carboxyl groups by oxidation or hydrolysis. Preferred materials are (i) monounsaturated $C_4$ to $C_{10}$ dicarboxylic acids wherein (a) the carboxyl groups are vicinyl, i.e., located on adjacent carbon atoms, and (b) at least one, preferably both, of said adjacent carbon atoms are part of said monounsaturation; or (ii) derivatives of (i) such as anhydrides or $C_1$ to $C_5$ alcohol derived mono- or diesters of (i) . Upon reaction with the ethylene copolymer, the monounsaturation of the dicarboxylic acid, anhydride, or ester becomes saturated. Thus, for example, maleic anhydride becomes a hydrocarbyl substituted succinic anhydride.

Maleic anhydride or a derivative thereof is preferred as it does not appear to homopolymerize appreciably but grafts onto the ethylene copolymer to give two carboxylic acid functionalities. Such preferred materials have the generic formula

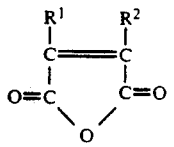

wherein $R^1$ and $R^2$ are hydrogen. Suitable examples additionally include chloro-maleic anhydride, itaconic anhydride, or the corresponding dicarboxylic acids, such as maleic acid or fumaric acid or their monoesters, etc.

As taught by U.S. Pat. No. 4,160,739 and U.S. Pat. No. 4,161,452, both of which are incorporated herein by reference, various unsaturated comonomers may be grafted on the olefin copolymer together with the unsaturated acid component, e.g., maleic anhydride. Such graft monomer systems may comprise one or a mixture of comonomers different from the unsaturated acid component and which contain only one copolymerizable double bond and are copolymerizable with said unsaturated acid component. Typically, such comonomers do not contain free carboxylic acid groups and are esters containing alpha, beta-ethylenic unsaturation in the acid or alcohol portion; hydrocarbons. both aliphatic and aromatic, containing alpha, beta-ethylenic unsaturation, such as the $C_4$–$C_{12}$ alpha olefins, for example isobutylene, hexene, nonene, dodecene, etc.; styrenes, for example styrene, alpha-methyl styrene, p-methyl styrene, p-sec. butyl styrene, etc.; and vinyl monomers, for example vinyl acetate, vinyl chloride, vinyl ketones such as mthyl and ethyl vinyl ketone, etc. Comonomers containing functional groups which may cause crosslinking, gelation or other interfering reactions should be avoided, although minor amounts of such comonomers (up to about 10% by weight of the comonomer system) often can be tolerated.

Specific useful copolymerizable comonomers include the following:

(a) Esters of saturated acids and unsaturated alcohols wherein the saturated acids may be monobasic or polybasic acids containing up to about 40 carbon atoms such as the following: acetic, propionic, butyric, valeric, caproic, stearic, oxalic, malonic, succinic, glutaric, adipic, pimelic, suberic, azelaic, sebacic, phthalic, isophthalic, terephthalic, hemimellitic, trimellitic, trimesic and the like, including mixtures. The unsaturated alcohols may be monohydroxy or polyhydroxy alcohols and may contain up to about 40 carbon atoms, such as the following: allyl, methallyl, crotyl, 1-chloroallyl, 2-chloroallyl, cinnamyl, vinyl, methyl vinyl, 1-phenallyl, butenyl, propargyl, 1-cyclohexene-3-ol, oleyl, and the like, including mixtures.

(b) Esters of unsaturated monocarboxylic acids containing up to about 12 carbon atoms such as acrylic, methacrylic and crotonic acid, and an esterifying agent containing up to about 50 carbon atoms, selected from saturated alcohols and alcohol epoxides. The saturated alcohols may preferably contain up to about 40 carbon atoms and include monohydroxy compounds such as: methanol, ethanol, propanol, butanol, 2-ethylhexanol, octanol, dodecanol, cyclohexanol, cyclopentanol, neopentyl alcohol, and benzyl alcohol; and alcohol ethers such as the monomethyl or monobutyl ethers of ethylene or propylene glycol, and the like, including mixtures. The alcohol epoxides include fatty alcohol epoxides, glycidol, and various derivatives of alkylene oxides, epichlorohydrin, and the like, including mixtures.

The components of the graft copolymerizable system are used in a ratio of unsaturated acid monomer component to comonomer component of about 1:4 to 4:1, preferably about 1.2 to 2:1 by weight.

GRAFTING OF THE ETHYLENE COPOLYMER

The grafting of the ethylene copolymer with the ethylenically unsaturated carboxylic acid material to form reactant (A) may be by any suitable method, such as thermally by the "ene" reaction, using copolymers containing unsaturation, such as ethylene-propylene-diene polymers either chlorinated or unchlorinated, extruder or masticator grafting, or more preferably it is by free-radical induced grafting in solvent, preferably in a mineral lubricating oil as solvent.

The free-radical induced grafting of ethylenically unsaturated carboxylic acid materials in solvents, such as benzene, is known in the art and disclosed, inter alia, in U.S. Pat. No. 2,236,917, incorporated herein by reference. The free-radical grafting is preferably carried out using free radical initiators such as peroxides and hydroperoxides, and nitrile compounds, preferably those which have a boiling point greater than about 100° C. and which decompose thermally within the grafting temperature range to provide said free radicals. Representative of these free-radical initiators are azobutyronitrile, 2,5-dimethyl-hex-3-yne-2, 5 bis-tertiary-butyl peroxide (sold as Luperso 130) or its hexane analogue, di-tertiary butyl peroxide and dicumyl peroxide. The initiator is generally used at a level of between about 0.005% and about 1%, based on the total weight of the polymer solution, and temperatures of about 150° to 220° C.

The ethylenically unsaturated carboxylic acid material, preferably maleic anhydride, will be generally used in an amount ranging from about 0.01% to about 104, preferably 0.1 to 2.0%, based on weight of the initial total solution. The aforesaid carboxylic acid material and free radical initiator are generally used in a weight percent ratio of ethylenically unsaturated carboxylic acid material to free radical initiator of about 1.0:1 to 30:1, preferably 3.0:1 to 6:1.

The initiator grafting is preferably carried out in an inert atmosphere, such as that obtained by nitrogen blanketing. While the grafting can be carried out in the presence of air, the yield of the desired graft polymer is generally thereby decreased as compared to grafting under an inert atmosphere substantially free of oxygen. The grafting time will usually range from about 0.1 to 12 hours, preferably from about 0.5 to 6 hours, more preferably 0.5 to 3 hours. The graft reaction will be usually carried out to at least approximately 4 times, preferably at least about 6 times the half-life of the free-radical initiator at the reaction temperature employed, e.g., with 2,5-dimethyl hex-3-yne-2, 5-bis(t-butyl peroxide) 2 hours at 160° C. and one hour at 170° C., etc.

In the grafting process, usually the copolymer solution is first heated to grafting temperature and thereafter said unsaturated carboxylic acid material and initiator are added with agitation, although they could have been added prior to heating. When the reaction is complete, the excess acid material can be eliminated by an inert gas purge, e.g., nitrogen sparging. Preferably the carboxylic acid material that is added is kept below its solubility limit in the polymer solution, e.g., below about 1 wt. %, preferably below 0.4 wt. % or less, of free maleic anhydride based on the total weight of polymer-solvent solution, e.g., ethylene copolymer mineral lubricating oil solution. Continuous or periodic addition of the carboxylic acid material along with an appropriate portion of initiator, during the course of the reaction, can be utilized to maintain the carboxylic acid below its solubility limits, while still obtaining the desired degree of total grafting.

In the grafting step the maleic anhydride or other carboxylic acid material used may be grafted onto both the polymer and the solvent for the reaction. Many solvents such as dichlorobenzene are relatively inert and may be only slightly grafted, while mineral oil will tend to be more grafted. The exact split of graft between the substrates present depends upon the polymer and its reactivity, the reactivity and type of solvent, the concentration of the polymer in the solvent, and also upon the maintenance of the carboxylic acid material in solution during the course of the reaction and minimizing the presence of dispersed, but undissolved acid, e.g., the maleic anhydride. The undissolved acid material appears to have an increased tendency to react to form oil insoluble materials as opposed to dissolved acid material. The split between grafted solvent and grafted polymer may be measured empirically from the infrared analyses of the product dialyzed into solvent and polymer fractions.

The grafting is preferably carried out in a mineral lubricating oil which need not be removed after the grafting step but can be used as the solvent in the subsequent reaction of the graft polymer with the amine material and as a solvent for the end product to f orm the lubricating additive concentrate. The oil having attached, grafted carboxyl groups, when reacted with the amine material will also be converted to the corresponding derivatives.

The solution grafting step when carried out in the presence of a high temperature decomposable peroxide can be accomplished without substantial degradation of the chain length (molecular weight) of the ethylene containing polymer.

THE POLYAMINES

The amine component (B) which may be reacted with the grafted ethylene copolymer (A) will have two or more primary amine groups, wherein the primary amine groups may be unreacted, or wherein one of the amine groups may already be reacted.

Preferred amines are aliphatic saturated amines, including those of the general formulae;

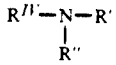

(I)

and

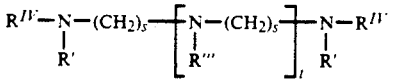

(Ia)

wherein $R^{IV}$, R', R'' and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkyl-amino $C_2$ to $C_6$ alkylene radicals; and wherein R'' and R''' can additionally comprise a moiety of the formula

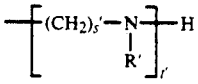

(Ib)

wherein R' is as defined above, and wherein each s and s' can be the same or a different number of from 2 to 6, preferably 2 to 4; and t and t' can be the same or different and are each numbers of typically from 0 to 10, preferably about 2 to 7, most preferably about 3 to 7, with the proviso that t+t' is not greater than 10. To assure a facile reaction it is preferred that $R^{IV}$, R', R'', R''', (s), (s'), (t) and (t') be selected in a manner sufficient to provide the compounds of formula Ia with typically at least two primary amino groups. This can be achieved by selecting at least one of said $R^{IV}$, R'', or R''' groups to be hydrogen or by letting (t) in formula Ia be at least one when R''' is H or when the (Ib) moiety possesses a primary a amino group.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene) triamine; di-(1,3-propylene) triamine; N,N-dimethyl-1, 3-diaminopropane; N,N-di-(2-aminoethyl) ethylene diamine; N,N-di (2-hydroxyethyl)-1,3-propylene diamine; N-dodecyl-1,3propane diamine; and mixtures thereof.

Other useful amine compounds include: alicyclic diamines such as 1,4-di(aminoethyl) cyclohexane, and N-aminoalkyl piperazines of the general formula:

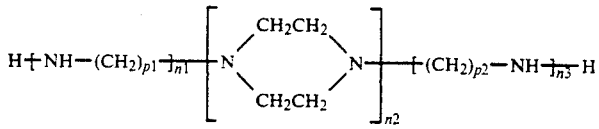

(II)

wherein $p_1$ and $p_2$ are the same or different and are each integers of from 1 to 4, and $n_1$, $n_2$ and $n_3$ are the same or different and are each integers of from 1 to 3.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and corresponding piperazines. Low cost poly(ethyleneamine) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulae:

$$NH_2\text{—alkylene—(—O-alkylene—)—}NH_2 \quad \text{(III)}$$

where m has a value of about 3 to 70 and preferably 10 to 35; and $$R^4\text{—[-alkylene—(—O-alkylene)—}NH_2] \quad \text{(IV)}$$

where n has a value of about 1 to 40, with the provision that the sum of all the n's is from about 3 to about 70, and preferably from about 6 to about 35, and $R^V$ is a substituted saturated hydrocarbon radical of up to 10 carbon atoms, wherein the number of substituents on the $R^V$ group is from 3 to 6, and "a" is a number from 3 to 6 which represents the number of substituents on $R^V$. The alkylene groups in either formula (III) or (IV) may be straight or branched chains containing about 2 to 7, and preferably about 2 to 4 carbon atoms.

Particularly preferred polyamine compounds are the polyoxyalkylene polyamines of Formulae III and IV, and the alkylene polyamines represented by the formula

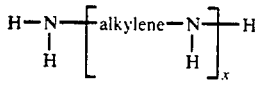

(V)

wherein x is an integer of about 1 to 10, preferably about 2 to 7, and the alkylene radical is a straight or branched chain alkylene radical having 2 to 7, preferably about 2 to 4 carbon atoms.

Examples of the alkylene polyamines of formula (V) include methylene amines, ethylene amines, butylene amines, propylene amines, pentylene amines, hexylene amines, heptylene amines, octylene amines, other polymethylene amines, the cyclic and higher homologs of these amines such as the piperazines, the amino-alkyl-substituted piperazines, etc. These amines include, for example, ethylene diamine, diethylene triamine, triethylene tetramine, propylene diamine, di(-heptamethylene)triamine, tripropylene tetramine, tetraethylene pentamine, trimethylene diamine, pentaethylene hexamine, di(trimethylene)triamine, 2-heptyl-3-(2-aminopropyl)-imidazoline, 4-methylimidazoline, 1,3-bis-(2-aminopropyl)-imidazoline, pyrimidine, 1-(2-aminopropyl)piperazine, 1,4-bis(2-aminoethyl)piperazine, N,N'-dimethyaminopropyl amine, N,N'-dioctylethyl amine, N-octyl-N'-methylethylene diamine, 2-methyl-1-(2-aminobutyl)piperazine, etc. Other higher homologs which may be used can be obtained by condensing two or more of the above-mentioned alkylene amines in a known manner.

The ethylene amines which are particularly useful are described, for example, in the Encyclopedia of Chemical Technology under the heading of "Ethylene Amines" (Kirk and Othmer), Volume 5, pgs. 898–905; Interscience Publishers, New York (1950), incorporated herein by reference. These compounds are prepared by the reaction of an alkylene chloride with ammonia. This results in the production of a complex mixture of alkylene amines, including cyclic condensation products such as piperazines. While mixtures of these amines may be used for purposes of this invention, it is obvious that pure alkylene amines may be used with complete satisfaction.

The polyoxyalkylene polyamines of formulae III and IV, preferably polyoxyalkylene diamines and polyoxyalkylene triamines, may have average molecular weights ranging from about 200 to about 4000 and preferably from about 400 to about 2000. The preferred polyoxyalkylene polyamines include the polyoxyethylene and the polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

THE ALDEHYDE MATERIAL

The aldehyde reactants employed in preparing the materials of this invention will generally comprise formaldehyde or paraformaldehyde, although it will be understood that other aldehyde-group containing compounds, such as $C_2$ to $C_{10}$ hydrocarbyl aldehydes (e.g., butyraldehyde, acetaldehyde, propionaldehyde, and the like) can also be employed. A preferred group of aldehyde materials are compounds of the formula: R"CHO, wherein R" is H, aliphatic hydrocarbon radical (e.g., having from 1 to 4 carbon atoms), or aromatic radical (e.g., having from 6 to 10 carbon atoms).

THE HETEROCYCLIC NITROGEN REACTANTS

The heterocyclic nitrogen reactants useful in present invention comprise heterocyclic compounds containing a 5- or 6- membered ring with one nitrogen hetero-atom or two or three adjacent nitrogen hetero-atoms, in which two adjacent carbon atoms of the heterocyclic ring may form part of a further 6-aromatic, heterocyclic or alicyclic ring system, wherein the heterocyclic compound contains at least one —N(H)— ring group. The heterocyclic compound can contain other hetero-atoms, usually O or S. Preferably, the heterocyclic ring is unsaturated.

The 6 membered ring system, part of which may be formed by two adjacent carbon atoms of the heterocyclic ring, can comprise an aromatic ring system, for example, a benzene ring or naphthalene ring system. This adjacent 6-numbered aromatic ring system can also comprise a heterocyclic ring and an ethylenically unsaturated alicyclic ring system.

The heterocyclic ring and the adjacent 6-numbered ring system may be substituted or unsubstituted. (Preferably substitution in such systems occurs on carbon-atoms of the ring). Suitable substituents comprise alkyl, alkaryl, aryl, aralkyl or alkenyl, such as alkyl groups of from 1–10 carbon atoms (methyl, ethyl, propyl, butyl, pentyl, decyl and the like), aryl are from 6–10 carbon atoms (such as phenol and naphthyl), alkaryl and aralkyl are from 7–10 carbon atoms (tolyl, xylyl, ethylphenyl, and the like) and alkenyl of 2–10 carbon atoms (such as ethenyl, propenyl, butenyl, decenyl, and the like). Suitable substiutents also include polar substituents, provided that the polar substituents are not present in proportions sufficiently large to alter significantly the hydrocarbon character of the hydrocarbyl group. Such polar substituents are exemplified by chloro, bromo, keto, etheral, aldehydo or nitro. The upper limit with respect to the proportion of such polar substituents on the group is about 10 wt % based on the weight of the hydrocarbyl portion of the group. Such polar substituent containing groups are referred to as hydrocarbyl groups throughout this specification.

Preferred herein are heterocyclic compounds of the formula:

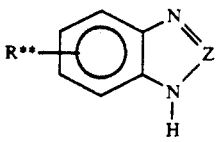

wherein Z is N, C(H) or C(R*), and R** is H, —OH, —Cl, —I or R*, wherein R* is $C_1$ to $C_{24}$ hydrocarbyl (most preferably H or $C_1$ to $C_3$ alkyl).

Exemplary of heterocyclic reactants useful in this invention are triazole, benzotriazole, 5-methyl benzotriazole, 5-ethyl benzotriazole, 5-butyl benzotriazole, 5-propyl benzotriazole, 5-dodecyl benzotriazole, 2-methyl benzotriazole, 2-ethyl benzotriazole, 2-butyl benzotriazole, 2-propyl benzotriazole, 2-dodecyl benzotriazole, 5,7-dimethyl benzotriazole, 5,7-diethyl benzotriazole, 5,7-dibutyl benzotriazole, 5,7-dipropyl benzotriazole, 5,7-didodecyl benzotriazole, naphthotriazole, 5-methyl naphthotriazole, 5-ethyl naphthotriazole, 5-butyl naphthotriazole, 5-propyl naphthotriazole, 5-dodecyl naphthotriazole, imidazole, 4-methyl imidazole, 4-ethyl imidazole, 4-butyl imidazole, 4-propyl imidazole, 4-dodecyl imidazole, 5-methyl imidazole, 5-ethyl imidazole, 5-butyl imidazole, 5-propyl imidazole, 5-dodecyl imidazole, benzimidazole, 5-methyl benzimidazole, 5-ethyl benzimidazole, 5-butyl benzimidazole, 5-propyl benzimidazole, 5-dodecyl benzimidazole, 2-methyl benzimidazole, 2-ethyl benzimidazole, 2-butyl benzimidazole, 2-propyl benzimidazole, 2-dodecyl benzimidazole, 5,7-dimethyl benzimidazole, 5,7-diethyl benzimidazole, 5,7-dibutyl benzimidazole, 5,7-dipropyl benzimidazole, 5,7-didodecyl benzimidazole, pyrrole, 3-methyl pyrrole, 3-ethyl pyrrole, 3-butyl pyrrole, 3-propyl pyrrole, 3-dodecyl pyrrole, 4-methyl pyrrole, 4-ethyl pyrrole, 4-butyl pyrrole, 4-propyl pyrrole, 4-dodecyl pyrrole, pyrazole, 5-methyl benzpyrazole, 5-ethyl benzpyrazole, 5-butyl benzpyrazole, 5-propyl benzpyrazole, 5-dodecyl benzpyrazole, 7-methyl benzpyrazole, 6-ethyl benzpyrazole, 6-butyl benzpyrazole, 6-propyl benzpyrazole, 2-dodecyl benzpyrazole, 5,7-dimethyl benzpyrazole, 5,7-diethyl benzpyrazole, 5,7-dibutyl benzpyrazole, 5,7-dipropyl benzpyrazole, 5,7-didodecyl benzpyrazole, 2-pyrroline, 3-pyrroline, 3-pyrazoline, carbazole, 5-methyl carbazole, indole, 3-methyl indole, 3-ethyl indole, 3-butyl indole, 3-propyl indole, 3-dodecyl indole, 4-methyl indole, 4-ethyl indole, 4-butyl indole, 4-propyl indole, 4-dodecyl indole, purine, phenothiazine, phenoxazine, perimidine, and the like.

Most preferred are benzotriazole and tolyltriazole.

THE DICARBOXYLIC ACID MATERIAL

The hydrocarbyl substituted dicarboxylic acid material (E) which is optionally used to make the multifunctional viscosity index improver-antioxidant of the instant invention includes the reaction product of $C_8$ to $C_{500}$ hydrocarbon, preferably long chain hydrocarbon polymer, generally a polyolefin, with (i) monounsaturated $C_4$ to $C_{10}$ dicarboxylic acid wherein (a) the carboxyl groups are vicinyl, i.e., located on adjacent carbon atoms, and (b) at least one, preferably both, of said adjacent carbon atoms are part of said mono unsaturation; or with (ii) derivatives of (i) such as anhydrides or $C_1$ to $C_5$ alcohol derived mono- or diesters of (i). Upon reaction with the hydrocarbon polymer, the monounsaturation of the dicarboxylic acid, anhydride, or ester becomes saturated. Thus, for example, maleic anhydride becomes a hydrocarbyl substituted succinic anhydride.

Typically, from about 0.5 to about 3, preferably from about 0. 7 to about 2, and more preferably from about 1.0 to about 2.0 moles of said unsaturated $C_4$ to $C_{10}$ dicarboxylic acid, anhydride or ester are charged to the reactor per mole of polyolefin charged.

Normally, not all of the polyolefin reacts with the unsaturated acid or derivative and the hydrocarbyl substituted dicarboxylic acid material will contain unreacted polyolefin. The unreacted polyolefin is typically not removed from the reaction mixture (because such removal is difficult and would be commercially infeasible) and the product mixture, stripped of any unreacted monounsaturated $C_4$ to $C_{10}$ dicarboxylic acid, anhydride, or ester is employed for further reaction with the amine or alcohol as described hereinafter to make the dispersant.

Characterization of the average number of moles of dicarboxylic acid, anhydride, or ester, which have reacted per mole of polyolefin charged to the reaction (whether it has undergone reaction or not) is defined herein as functionality. Said functionality is based upon (i) determination of the saponification number of the resulting product mixture using potassium hydroxide; and (ii) the number average molecular weight of the polymer charged, using techniques well known in the art. Functionality is defined solely with reference to the resulting product mixture. Although the amount of said reacted polyolefin contained in the resulting product mixture can be subsequently modified, i.e., increased or decreased by techniques known in the art, such modifications do not alter functionality as defined above. The term hydrocarbyl substituted dicarboxylic acid material is intended to refer to the product mixture whether it has undergone such modification of not.

Accordingly, the functionality of the long chain hydrocarbyl substituted dicarboxylic acid material will generally be at least 0.5, preferably at least about 0.8, more preferably at least about 1.0, and is generally from 0.5 to about 2.0, preferably from about 1.0 to about 1.9, and more preferably from about 1.0 to about 1.7.

Exemplary of such unsaturated mono and dicarboxylic acids, or anhydrides and esters thereof are fumaric acid, itaconic acid, maleic acid, maleic anhydride, chloromaleic acid, chloromaleic anhydride, acrylic acid, methacrylic acid, crotonic acid, cinnamic acid, etc.

Preferred olefin polymers for reaction with the unsaturated dicarboxylic acid, or anhydride are polymers comprising a major molar amount of $C_2$ to $C_{28}$, e. g. $C_2$ to $C_5$, monoolefin. Such olefins include ethylene, propylene, butene, isobutylene, pentene, octene-1, styrene, etc. The polymers can be homopolymers such as polybutene, as well as copolymers of two or more of such olefins such as copolymers of: ethylene and propylene; butylene and isobutylene; propylene and isobutylene; etc. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene; or a copolymer of ethylene, propylene and 1,4-hexadiene; etc.

In some cases the olefin polymer may be completely saturated, for example an ethylene-propylene copolymer made by a Ziegler-Natta synthesis using hydrogen as a moderator to control molecular weight.

The olefin polymers will usually have number average molecular weights ($\overline{M}_n$) within the range of about 400 and about 10,000, preferably between about 400 to 5000, and more preferably between about 600 and about 2500. Particularly useful olefin polymers have number average molecular weights within the range of about 800 and about 1100 with approximately one terminal double bond per polymer chain. An especially useful starting material for the high functionality long chain hydrocarbyl substituted dicarboxylic acid producing material of this invention is poly(butene) or poly($C_4$-alkene), e.g., poly(n-butene), polyisobutylene, and mixtures thereof.

Processes for reacting the olefin polymer with the $C_4$–$C_{10}$ unsaturated dicarboxylic acid, anhydride or ester are known in the art. For example, the olefin polymer and the dicarboxylic acid material may be simply heated together as disclosed in U.S. Pat. Nos. 3,361,673 and 3,401,118 to cause a thermal "ene" reaction to take place. Alternatively, the olefin polymer can be first halogenated, for example, chlorinated or brominated to about 1 to 8 , preferably 3 to 7 wt. % chlorine or bromine, based on the weight of polymer, by passing the chlorine or bromine through the polyolefin at a temperature of 60 to 160° C., e.g., 110° to 130° C., for about 0.5 to 10, preferably 1 to 7 hours. The halogenated polymer may then be reacted with sufficient unsaturated acid or anhydride at 100 to 250° C., usually about 180° to 235° C., for about 0.5 to 10 hours, e.g., 3 to 8 hours. Processes of this general type are taught, inter alia, in U.S. Pat. Nos. 3,087,436; 3,172,892; 3,272,746; and U.S. patent application Ser. No. 919,395, filed Oct. 16, 1986, all of which are incorporated herein by reference.

Alternatively, the olefin polymer and the unsaturated acid material are mixed and heated while adding chlorine to the hot material. Processes of this type are disclosed in U.S. Pat. Nos. 3,215,707; 3,231,587; 3,912,764; 4,110,349; 4,234,435; and in U.K. 1,440,219.

By the use of halogen, about 65 to 95 wt. % of the polyolefin, e.g., poly(butene), will normally react with the dicarboxylic acid material. Upon carrying out a thermal reaction without the use of halogen or a catalyst, then usually only about 50 to 85 wt. % of the polyisobutylene will react. Chlorination helps increase the reactivity.

The most preferred long chain hydrocarbyl substituted dicarboxylic acid material is polyisobutenyl succinic anhydride having a functionality of from 1.2 to about 2.0, preferably from about 1.3 to about 1.9, and more preferably from about 1.4 to about 1.8.

PREPARATION OF PRODUCTS

In accordance with one embodiment, the grafted ethylene copolymer (A), amine (B) and hydrocarbyl substituted dicarboxylic acid material (E) (in any order) to form an amine-substituted grafted ethylene copolymer adduct (I-1) having reactive amino groups and bearing substituent groups derived from the hydrocarbyl substituted dicarboxylic acid material. The adduct (I-1) can then be contacted with aldehyde (C) and heterocyclic reactant (D) under condensation reaction conditions to form a reaction product (I-2) wherein the heterocyclic nitrogen reactants are attached to the nitrogen atoms of the adduct (I-1) through the residue of the aldehyde employed, e.g., —CH($CH_3$)— in the case of $CH_3CHO$.

The grafted ethylene copolymer, preferably in solution generally equal to about 5 to 30 wt. %, preferably 10 to 20 wt. % polymer, can be readily reacted with a mixture of amine and hydrocarbyl substituted dicarboxylic acid material by heating said mixture at a temperature of from about 100° C. to 250° C., preferably from 150° to 200° C., for from 0.1 to 10 hours, usually about 0.5 to about 3 hours. The heating is preferably carried out to favor formation of imides rather than amides and salts. Thus, imide formation will give a lower viscosity of the reaction mixture than amide formation and particularly lower than salt formation. This lower viscosity permits the utilization of a higher concentration of grafted ethylene copolymer in the reaction mixture. Removal of water, e.g., by $N_2$ stripping during slow addition of the amine with stirring assures completion of the imidation reaction. Reaction ratios can vary considerably, depending upon the reactants, amounts of excess, type of bonds formed, etc. The amount of polyamine used is an amount effective to enhance or improve the dispersant properties of the compounds of the instant invention. Generally, the amount of polyamine used is an amount which is effective to provide from about 0.5 to about 1.5 equivalents, preferably from about 0.8 to about 1.2 equivalents, and more preferably from about 0.9 to about 1.0 equivalents of primary amine per equivalent of acid of the grafted dicarboxylic acid moiety, e.g., succinic anhydride.

The amount of hydrocarbyl substituted dicarboxylic acid material utilized is an amount which is effective to prevent cross-linking or excessive chain-extenion of the grafted ethylene copolymer during amination/imidation thereof. Generally this amount is from about 0.3 to about 1.2, preferably from about 0.6 to about 1.2, more preferably from about 0.9 to about 1.1 mole equivalents of the hydrocarbyl substituted dicarboxylic acid material per mole of the grafted dicarboxylic acid moiety content, e.g., grafted maleic anhydride content, of the grafted ethylene copolymer and solvent, if any, such as oil.

Alternatively, the polyamine and the hydrocarbyl substituted dicarboxylic acid material may be prereacted to form an amine-acid adduct, and this adduct may then be reacted with the grafted ethylene copolymer. In the case of the amine-acid adduct the acid moiety of the hydrocarbyl substituted dicarboxylic acid material is generally attached to the polyamine moiety through salt, imide, amide, amidine, ester or other linkages formed with one primary amine group of said polyamine so that another primary amine group of the polyamine is still available for reaction with the acid moieties of the grafted ethylene copolymer.

Usually, these adducts are made by condensing the hydrocarbyl substituted dicarboxylic material, preferably a succinic acid producing material such as alkenyl succinic anhydride, with a polyamine including those described above under "The Amines".

Formation of dicarboxylic acid polyamine adduct by reaction of polyamine with alkenyl succinic anhydride prepared from the reaction of a polyolefin or chlorinated polyolefin and maleic anhydride, etc., is well known in the art, as seen in U.S. Pat. No. 3,272,746.

Most preferred are the adducts made by reaction of the aforesaid alkylene polyamines, previously described, with a high functionality long chain polyalkenyl succinic anhydride.

Reaction, in the case of a polyamine, preferably amination and/or imidation of the hydrocarbyl substituted dicarboxylic acid material is usefully done as a solution reaction with said dicarboxylic acid material, usually polyisobutenylsuccinic anhydride, dissolved in a solvent such as mineral oil, to which the other reactant is added. The formation of the adducts in high yield can be effected by adding from about 0.5 to 3.3 preferably about 0.7 to 1.3, most preferably about 1 molar proportion of the alkylene polyamine per molar proportion of alkenyl succinic anhydride to said solution and heating the mixture at 140° C. to 165° C. or higher until the appropriate amount of water of reaction is evolved. Typically the mineral oil solvent is adjusted so that it constitutes 50% by weight of the final acyl nitrogen compound solution.

Another, and generally preferred, method of making the amine-substituted grafted ethylene copolymer adduct (I-1) employed in the instant invention is a sequential reaction process comprising (i) forming the grafted ethylene copolymer, (ii) adding to said grafted ethylene copolymer the hydrocarbyl substituted dicarboxylic acid material so as to form a mixture of said grafted ethylene copolymer and said hydrocarbyl substituted dicarboxylic acid material, and (iii) reacting this mixture with the polyamine.

The amine-substituted grafted ethylene copolymer adduct (I-1) is reacted with the aldehyde and heterocyclic reactant in accordance with this invention by contacting in a reaction zone. The reactants are contacted for a time and under conditions effective to react the aldehyde, reactive amine groups of the amine-substituted grafted ethylene copolymer adduct (I-1) and the —N(H)— groups of the heterocyclic nitrogen reactant to form a Mannich Base condensation product containing heterocyclic nitrogen units bound to at least a portion of the amine-substituted grafted ethylene copolymer adduct (I-1) through a hydrocarbylene group derived from the aldehyde (e.g., a methylene ($—CH_2—$) group derived from formaldehyde).

The conditions of temperature and pressure under which the reaction occurs can vary widely, and generally temperatures of from about 0° to 200° C., preferably from about 25° to 150° C. Temperatures of less than 0° C. can be used but undesirably slow reaction rates can result. Reaction temperatures of greater than 200° C., up to the decomposition point of the reactants or reaction products, can also be employed, with the attendant formation of by-products. The pressures in the reaction zone will be sufficient to maintain a liquid reaction medium, and generally pressures from about 0.1 to 1000 kPa, and preferably from about 1 to 100 kPa, will be employed.

The reaction can be carried out in a batchwise, continuous or semicontinuous manner, in one or more reaction zones. The reaction can be conducted in any conventional apparatus such as stirred tank reactors, tubular flow reactors and the like.

The reactants can be charged to the reaction zone continuously or intermittently, together or sequentially, in any order. Generally, the amine-substituted grafted ethylene copolymer adduct (I-1) and any solvent for the reaction will be first charged to the reaction zone, followed by aldehyde reactant, and then by addition of the heterocyclic nitrogen reactant, which can, if desired, be introduced to the reaction zone as a mixture of the aldehyde and heterocyclic nitrogen reactants. Preferably, the amine-substituted grafted ethylene copolymer adduct (I-1) is not contacted with the heterocyclic nitrogen reactant in the absence of the aldehyde reactant at reaction conditions.

The process of the present invention can be accomplished using a wide range of ratios of reactants, and the amine-substituted grafted ethylene copolymer adduct (I-1):aldehyde reactant:heterocyclic nitrogen reactant will generally be charged in a ratio of from 1:0.001:0.001 to 1:10:10, preferably from 1:0.005:0.005 to 1:5:5, and more preferably from 1:0.01:0.01 to 1:1.0:1.0, molar equivalents of amine-substituted grafted ethylene copolymer adduct (I-1):moles of aldehyde reactant:moles of heterocyclic nitrogen reactant.

The reaction can be conducted in the absence, or in the presence, of a diluent or solvent for the amine-substituted grafted ethylene copolymer adduct (I-1). Suitable solvents include mineral and synthetic lubricating oils, and hydrocarbon solvents such as aliphatics, cycloaliphatics, and aromatic hydrocarbon solvents, or halogenated versions of such solvents. The most preferred solvent is mineral lubricating oil. Non-limiting illustrative examples of diluents or solvents are butane, pentane, hexane, heptane, cyclopentane, cyclohexane, cycloheptane, methyl cyclopentane, methyl cyclohexane, isooctane, benzene, toluene, xylene, chloroform, chlorobenzenes, tetrachloroethylene, dichloroethane and trichloroethane.

The reaction time can vary widely, and will depend on such factors as the amount of reactants employed, the size of the reaction vessel, the temperature and other factors. Generally, the reaction time will range from about 0.5 to 48 hours, and more typically from 2 to 12 hours.

Generally, from 20 to 90 wt. % (and preferably from 25 to 75 wt. %) of the N atoms in the amino-substituted polymer will be primary and/or secondary, and therefore reactive with the aldehyde and heterocyclic nitrogen reactants, and preferably at least about 1 wt. % of the reactive N atoms (e.g., from 1 to about 100 wt. %), more preferably at least about 20 wt. % (e.g., from 20 to about 80 wt. %) and most preferably from 25 to 75 wt. % of the reactive N atoms in the amino-substituted polymer will be reacted with the aldehyde and heterocyclic nitrogen reactant to form >N-ald-hetero N groups (wherein "ald" is the linking unit derived from the aldehyde reactant and "hetero N" is the residue of the heterocyclic nitrogen reactant).

A minor amount, e.g., 0.001 up to 50 wt. %, preferably 0.005 to 25 wt. %, based on the weight of the total composition, of the oil-soluble functionalized graft ethylene copolymers produced in accordance with this invention can be incorporated into a major amount of an oleaginous material, such as lubricating oil or hydrocarbon fuel, depending upon whether one is forming finished products or additives concentrates. When used in lubricating oil compositions, e.g., automotive or diesel crankcase lubricating oil, the nitrogen-containing or grafted polymer concentrations are usually within the range of about 0.01 to 10 wt. %, e.g., 0.1 to 6.0 wt. %, preferably 0.25 to 3.0 wt. %, of the total composition. The lubricating oils to which the products of this invention can be added include not only hydrocarbon oil derived from petroleum, but also include synthetic lubricating oils such as esters of dibasic acids; complex esters made by esterification of monobasic acids, polyglycols, dibasic acids and alcohols; polyolefin oils, etc.

The multi-functional viscosity index improvers of the instant invention may be utilized in a concentrate form, e.g., from about 5 wt. % up to about 50 wt. %, preferably 7 to 25 wt. %, in oil, e.g., mineral lubricating oil, for ease of handling, and may be prepared in this form by carrying out the reaction of the invention in oil as previously discussed.

The compositions produced in accordance with the present invention have been found to be particularly useful as fuel and lubricating oil additives.

When the compositions of this invention are used in normally liquid petroleum fuels, such as middle distillates boiling from about 65° to 430° F. including kerosene, diesel fuels, home heating fuel oil, jet fuels, etc., a concentration of the additive in the fuel in the range of typically from 0.001 wt. % to 0.5 wt. %, preferably 0.005 wt. % to 0.2 wt. %, based on the total weight of the composition, will usually be employed. These additives can contribute fuel stability as well as dispersant activity and/or varnish control behavior to the fuel.

The compounds of this invention find their primary utility, however, in lubricating oil compositions, which employ a base oil in which the additives are dissolved or dispersed. Such base oils may be natural or synthetic.

Thus, base oils suitable for use in preparing the lubricating compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the additives of the present invention in base oils conventionally employed in and/or adapted for use as power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

Thus, the additives of the present invention may be suitably incorporated into synthetic base oils such as alkyl esters of dicarboxylic acids, polyglycols and alcohols; polyalpha-olefins, polybutenes, alkyl benzenes, organic esters of phosphoric acids, polysilicone oils, etc. selected type of lubricating oil composition can be included as desired.

The additives of this invention are oil-soluble, dissolvable in oil with the aid of a suitable solvent, or are stably dispersible materials. oil-soluble, dissolvable, or stably dispersible as that terminology is used herein does not necessarily indicate that the materials are soluble, dissolvable, miscible, or capable of being suspended in oil in all proportions. It does mean, however, that the additives, for instance, are soluble or stably dispersible in oil to an extent sufficient to exert their intended effect in the environment in which the oil is employed. Moreover, the additional incorporation of other additives may also permit incorporation of higher levels of a particular polymer adduct hereof, if desired.

Accordingly, while any effective amount of these additives can be incorporated into the fully formulated lubricating oil composition, it is contemplated that such effective amount be sufficient to provide said lube oil composition with an amount of the additive of typically from 0.01 to about 10, e.g., 0.1 to 6.0, and preferably from 0.25 to 3.0 wt. %, based on the weight of said composition.

The additives of the present invention can be incorporated into the lubricating oil in any convenient way. Thus, they can be added directly to the oil by dispersing, or dissolving the same in the oil at the desired level of concentration, typically with the aid of a suitable solvent such as toluene, cyclohexane, or tetrahydrofuran. Such blending can occur at room temperature or elevated.

Natural base oils include mineral lubricating oils which may vary widely as to their crude source, e.g., whether paraffinic, naphthenic, mixed, paraffinicnaphthenic, and the like; as well as to their formation, e.g., distillation range, straight run or cracked, hydrofined, solvent extracted and the like.

More specifically, the natural lubricating oil base stocks which can be used in the compositions of this invention may be straight mineral lubricating oil or distillates derived from paraffinic, naphthenic, asphaltic, or mixed base crudes, or, if desired, various blends oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents of the type of phenol, sulfur dioxide, furfural, dichlorodiethyl ether, nitrobenzene, crotonaldehyde, etc.

The lubricating oil base stock conveniently has a viscosity of typically about 2.5 to about 12, and preferably about 2.5 to about 9 cSt. at 100° C.

Thus, the additives of the present invention can be employed in a lubricating oil composition which comprises lubricating oil, typically in a major amount,.and the additive, typically in a minor amount, which is effective to impart enhanced dispersancy relative to the absence of the additive. Additional conventional additives selected to meet the particular requirements of a temperatures. In this form the additive per se is thus being utilized as a 100% active ingredient form which can be added to the oil or fuel formulation by the purchaser. Alternatively, these additives may be blended with suitable oil-soluble solvent and base oil to form concentrate, which may then be blended with a lubricating oil base stock to obtain the final formulation. Concentrates will typically contain from about 2 to 80 wt. %, by weight of the additive, and preferably from about 5 to 40% by weight of the additive.

The lubricating oil base stock for the additive of the present invention typically is adapted to perform selected function by the incorporation of additives therein to form lubricating oil compositions (i.e., formulations).

Representative additives typically present in such formulations include other viscosity modifiers, corrosion inhibitors, oxidation inhibitors, friction modifiers, other dispersants, anti-foaming agents, anti-wear agents, pour point depressants, detergents, rust inhibitors and the like.

Viscosity modifiers impart high and low temperature operability to the lubricating oil and permit it to remain shear stable at elevated temperatures and also exhibit acceptable viscosity or fluidity at low temperatures. These viscosity modifiers are generally high molecular weight hydrocarbon polymers including polyesters. The viscosity modifiers may also be derivatized to include other properties or functions, such as the addition of dispersancy properties.

These oil soluble viscosity modifying polymers will generally have weight average molecular weights of from about 10,000 to 1,000,000, preferably 20,000 to 500,000, as determined by gel permeation chromatography or light scattering methods.

Representative examples of suitable viscosity modifiers are any of the types known to the art including polyisobutylene, copolymers of ethylene and propylene, polymethacrylates, methacrylate copolymers, copolymers of an unsaturated dicarboxylic acid and vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt. % of a sulfide of phosphorus for ½ to 15 hours, at temperature in the range of about 66° to about 316° C. Neutralization of the phosphosulfurized hydrocarbon may be effected in the manner taught in U.S. Pat. No. 1,969,324.

Oxidation inhibitors, or antioxidants, reduce the tendency of mineral oils to deteriorate in service which deterioration can be evidenced by the products of oxidation such as sludge and varnish-like deposits on the metal surfaces, and by viscosity growth. Such oxidation inhibitors include alkaline earth metal salts of alkylphenolthioesters having preferably $C_5$ to $C_{12}$ alkyl side chains, e.g., calcium nonylphenol sulfide, barium toctylphenyl sulfide, dioctylphenylamine, phenylalphanaphthylamine, phospho-sulfurized or sulfurized hydrocarbons, etc.

Other oxidation inhibitors or antioxidants useful in this invention comprise oil-soluble copper compounds. The copper may be blended into the oil as any suitable oil soluble copper compound. By oil soluble it is meant that the compound is oil soluble under normal blending conditions in the oil or additive package. The copper compound may be in the cuprous or cupric form. The copper may be in the form of the copper dihydrocarbyl thio- or dithio-phosphates. Alternatively, the copper may be added as the copper salt of a synthetic or natural carboxylic acid. Examples of same thus include $C_{10}$ to $C_{18}$ fatty acids, such as stearic or palmitic acid, but unsaturated acids such as oleic or branched carboxylic acids such as napthenic acids of molecular weights of from about 200 to 500, or synthetic carboxylic acids, are preferred, because of the improved handling and solubility properties of the resulting copper carboxylates. Also useful are oil-soluble copper dithiocarbamates of the general formula $(R^{20}R^{21},NCSS)_zCu$ (where z is 1 or 2, and $R^{20}$ and $R^{21}$, are the same or different hydrocarbyl radicals containing from 1 to 18, and preferably 2 to 12, carbon atoms, and including radicals such as alkyl, alkenyl, aryl, aralkyl, alkaryl and cycloaliphatic radicals. Particularly preferred as $R^{20}$ and $R^{21}$, groups are alkyl groups of from 2 to 8 carbon atoms. Thus, the radicals may, for example, be ethyl, n-propyl, i-propyl, n-butyl, i-butyl, sec-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms (i.e., $R^{20}$ and $R^{21}$,) will generally be about 5 or greater. Copper sulphonates, phenates, and acetylacetonates may also be used.

Exemplary of useful copper compounds are copper $Cu^I$ and/or $Cu^{II}$ salts of alkenyl succinic acids or anhydrides. The salts themselves may be basic, neutral or acidic. They may be formed by reacting (a) polyalkylene succinimides (having polymer groups of $\overline{M}_n$ of 700 to 5,000) derived from polyalkylene-polyamines, which have at least one free carboxylic acid group, with (b) a reactive metal compound. Suitable reactive metal compounds include those such as cupric or cuprous hydroxides, oxides, acetates, borates, and carbonates or basic copper carbonate.

Examples of these metal salts are Cu salts of polyisobutenyl succinic anhydride, and Cu salts of polyisobutenyl succinic acid. Preferably, the selected metal employed is its divalent form, e.g., Cu+2. The preferred substrates are polyalkenyl succinic acids in which the alkenyl group has a molecular weight greater than about 700. The alkenyl group desirably has a $\overline{M}_n$ from about 900 to 1,400, and up to 2,500, with a $\overline{M}_n$ of about 950 being most preferred. Especially preferred is polyisobutylene succinic anhydride or acid. These materials may desirably be dissolved in a solvent, such as a mineral oil, and heated in the presence of a water solution (or slurry) of the metal bearing material. Heating may take place between 70° C. and about 200° C. Temperatures of 100° C. to 140° C. are entirely adequate. it may be necessary, depending upon the salt produced, not to allow the reaction to remain at a temperature above about 140° C. for an extended period of time, e.q., longer than 5 hours, or decomposition of the salt may occur.

The copper antioxidants (e.g., Cu-polyisobutenyl succinic anhydride, Cu-oleate, or mixtures thereof) will be generally employed in an amount of from about 50 to 500 ppm by weight of the metal, in the final lubricating or fuel composition.

Friction modifiers serve to impart the proper friction characteristics to lubricating oil compositions such as automatic transmission fluids.

Representative examples of suitable friction modifiers are found in U.S. Pat. No. 3,933,659 which discloses fatty acid esters and amides; U.S. Pat. No. 4,176,074 which describes molybdenum complexes of polyisobutyenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses S-carboxyalkylene hydrocarbyl succinimide, S-carboxyalkylene hydrocarbyl succinamic acid and mixtures thereof; U.S. Pat. No. 3,879,306 which discloses N(hydroxyalkyl)alkenylsuccinamic acids or succinimides: U.S. Pat. No. 3,932,290 which discloses reaction products of di- (lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference. The most preferred friction modifiers are succinate esters, or metal salts thereof, of hydrocarbyl substituted succinic acids or anhydrides and thiobisalkanols such as described in U. S. Pat. No. 4,344,853.

Dispersants maintain oil insolubles, resulting from oxidation during use, in suspension in the fluid thus preventing sludge flocculation and precipitation or deposition on metal parts. Suitable dispersants include high molecular weight alkyl succinimides, the reaction product of oil-soluble polyisobutylene succinic anhydride with ethylene amines such as tetraethylene pentamine and borated salts thereof.

Pour point depressants, otherwise known as lube oil flow improvers, lower the temperature at which the fluid will flow or can be poured. Such additives are well known. Typically of those additives which usefully optimize the low temperature fluidity of the fluid are $C_8$–$C_{18}$ dialkylfumarate vinyl acetate copolymers, polymethacrylates, and wax naphthalene. Foam control can be provided by an antifoamant of the polysiloxane type, e.g., silicone oil and polydimethyl siloxane.

Anti-wear agents, as their name implies, reduce wear of metal parts. Representatives of conventional antiwear agents are zinc dialkyldithiophosphate and zinc diaryldithiosphate.

Detergents and metal rust inhibitors include the metal salts of sulphonic acids, alkyl phenols, sulfurized alkyl phenols, alkyl salicylates, naphthenates and other oil soluble mono- and dicarboxylic acids. Highly basic (viz. overbased) metal sales, such as highly basic alkaline earth metal sulfonates (especially Ca and Mg salts) are frequently used as detergents. Representative examples of such materials, and their methods of preparation, are found in U.S. Pat. Nos. 4,867,890, 4,857,217 and 4,863,024, the disclosures of which is hereby incorporated by reference.

Some of these numerous additives can provide a multiplicity of effects, e.g., a dispersant-oxidation inhibitor. This approach is well known and need not be further elaborated herein.

Compositions when containing these conventional additives are typically blended into the base oil in amounts which are effective to provide their normal attendant function. Representative effective amounts of such additives are illustrated as follows:

| Additive | Wt. % a.i. (Broad) | Wt. % a.i. (Preferred) |
|---|---|---|
| Viscosity Modifier | .01-12 | .01-4 |
| Corrosion Inhibitor | .01-5 | .01-1.5 |
| Oxidation Inhibitor | .01-5 | .01-1.5 |
| Dispersant | .1-20 | .1-8 |
| Pour Point Depressant | .01-5 | .01-1.5 |
| Anti-Foaming Agents | .001-3 | .001-0.15 |
| Anti-War Agents | .001-5 | .001-1.5 |
| Friction Modifiers | .01-5 | .01-1.5 |
| Detergents/Rust Inhibitors | .01-10 | .01-3 |
| Mineral Oil Base | Balance | Balance |

When other additives are employed it may be desirable, although not necessary, to prepare additive concentrates comprising concentrated solutions or dispersions of the V.I.-dispersant (in concentrate amounts hereinabove described), together with one or more of said other additives (said concentrate when constituting an additive mixture being referred to herein as an additive package) whereby several additives can be added simultaneously to the base oil to form the lubricating oil composition. Dissolution of the additive concentrate into the lubricating oil may be facilitated by solvents and by mixing accompanied with mild heating, but this is not essential. The concentrate or additive-package will typically be formulated to contain the V.I.-dispersant or multi-functional viscosity index improver additive and optional additional additives in proper amounts to provide the desired concentration in the final formulation when the additive-package is combined with a predetermined amount of base lubricant. Thus, the products of the present invention can be added to small amounts of base oil or other compatible solvents along with other desirable additives to form additive-packages containing active ingredients in collective amounts of typically from about 2.5 to about 90%, and preferably from about 5 to about 75%, and most preferably from about 8 to about 50% by weight additives in the appropriate proportions with the remainder being base oil.

The final formulations may employ typically about 10 wt.% of the additive-package with the remainder being base oil.

All of said weight percents expressed herein are based on active ingredient (a.i.) content of the additive, and/or upon the total weight of any additive-package, or formulation which will be the sum of the a.i. weight of each additive plus the weight of total oil or diluent.

This invention will be further understood by reference to the following examples, wherein all parts, unless otherwise indicated, are parts by weight and all molecular weights are number average molecular weights as noted, and which include preferred embodiments of the invention.

In the following Examples, thickening efficiency (T.E.) is defined as the ratio of the weight percent of a polyisobutylene (sold an an oil solution by Exxon Chemical Co. as Paratone N), having a Staudinger Molecular Weight of 20,000 required to thicken a solvent-extracted neutral mineral lubricating oil, having a viscosity of 150 SUS at 37.8° C., a viscosity index of 105 and an ASTM pour point of 0° F., (Solvent 150 Neutral) to a viscosity of 12.4 centistokes at 98.9° C., to the weight percent of a test copolymer required to thicken the same oil to the same viscosity at the same temperature. T.E. is related to ($\overline{M}_n$)and is a convenient, useful measurement for formulation of lubricating oils of various grades.

The CCS viscosities in the following Examples were determined by diluting the products of Examples 1 and 2 with more S130N to a viscosity of 650 cs at 100° C. Then the cold cranking properties of 20/80 weight blends of the diluted products of Examples 1 and 2 with Enjay 102 mineral oil were determined in a high shear Cold cranking Stimulator (CCS) according to ASTM-D-2607-72 method at −18° C. for viscosity in centipoises.

The storage stability tests in the following Examples were conducted by storing 200 grams of the product in a pint bottle in an oven at 80° C. and then periodically measuring the viscosity at 100° C. in terms of centistokes. The viscosity is measured at the end of three week periods and calculated as the % per hour increase in centistoke viscosity.

EXAMPLE 1

Preparation of Non-Capped Imide Grafted Ethylene-Propylene Copolymer

In a 1 liter four neck round bottom flask equipped with stirrer, thermometer, nitrogen inlet and nitrogen outlet was charged with a 500 grams of 20 wt. % oil solution of an ethylene-propylene copolymer in S100N (Solvent 100 Neutral mineral oil). The solution was heated to 150° C. under nitrogen blanket and the temperature was held at 150° C. throughout the reaction. The polymer in oil concentrate was stripped with $N_2$ for 1 hour to eliminate water from the solution. The concentrate was then reacted with maleic anhydride (9 g) and ditertiary butyl peroxide (0.9 g) which were added in three stages at 20 min. intervals. The grafted product was stripped with $N_2$ for 2 hours at 150° C. to remove the unreacted maleic anhydride, and was found to have a graft level of 0.118 milliequivalent of succinic anhydride per gram of grafted material. To this solution was then added 139.44 grams of a 50 wt. % oil solution of polyisobutenyl succinic anhydride (PIBSA) having a functionality of about 1.05 (a polyisobutene $\overline{M}_n$ of about 950, a saponification number of 112 and about 12 wt. % unreacted polyisobutene) in S100NLP base oil. The resultant mixture was $N_2$ stripped for 0.5 hour and 5.73 grams of diethylenetriamine were added to this reaction mixture over a period of 15 minutes. The product was then $N_2$ stripped for one hour. The product was analyzed to contain 0.26 wt. %N, and was found to have a TE of 1.97.

Part of the product (33.95 grams) was then diluted with an amount of S100N mineral oil sufficient to reduce the viscosity of the reaction mixture to about 982 centistokes at 100° C. The diluted product was found to have a CCS viscosity (−20° C.) of 3,342 cp.

The kinetic viscosity (K.V.) of this diluted mixture was measured at 100° C, both initially and after storage for three weeks at 80° C. The results are given in Table 1.

EXAMPLE 2

Preparation of a Benzotriazole Reacted Imide Grafted Ethylene-Propylene Copolymer A reaction flask (as used in Example 1) was charged with 290 grams of the imide grafted ethylene-propylene copolymer product prepared in accordance with the procedure of Example 1 and was heated to 80° C. under nitrogen blanket. An aqueous solution (2.4 ml.) of 37% formaline (0.03 mole) was added to the above polymeric solution, and 3.93 g (0.033 mole) benzotriazole was then added as a 39.3 wt. % solution in ethanol. The solution was stirred at 80° C. for one hour and then stripped with nitrogen for one hour. The product was allowed to cool under nitrogen blanket, and analyzed to contain 0.66 wt. % total N. compared to the 0.26 wt. % N in the imide grafted copolymer charged to the reaction. The product was found to have a T.E. of 1.93. Part of the product was diluted as in Example 1 to reduce the viscosity of the reaction mixture to 845 cSt at 100° C. The diluted product was found to have a CCS viscosity of 3,138 cp.

The product thereby obtained was analyzed, and its IR spectra showed characteristic absorbtion peaks due to benzotriazole along with peaks due to the amine-substituted grafted ethylene copolymer. The product appears to be clean and apparently free of unreacted benzotriazole.

The kinetic viscosity (K.V.) of this diluted product was measured at 100° C., both initially and after storage for three weeks at 80° C. The results are given in Table 1.

TABLE 1

| | (Products stored at 80° C.) | | | |
|---|---|---|---|---|
| Example No. | Initial Viscosity (cSt) | Viscosity after 3 Weeks (cSt) | Change In Viscosity (cSt) (1) | Average Viscosity Increase %/Hour (2) |
| 1 | 982 | 1083 | +101 | +0.020 |
| 2 | 845 | 767 | −78 | −0.018 |

(1) (viscosity, 3 wks.) − (initial viscosity).
(2) [(change in viscosity)/(initial viscosity)] [100] /(504 hrs.)

EXAMPLE 3

The procedure of Example 3 is substantially repeated except that a solution of 1.2 ml of 37% formaline (0.015 mole) and a 36 wt. % ethanol solution of 1.8 g (0.015 mole) benzotriazole was used. The kinetic viscosity (K.V.) of this product was measured at 100° C., both initially and after storage for 44 days at 80° C. These results were compared with the uncapped product prepared by Example 1. The results are given in Table 2.

TABLE 2

| | (Products stored at 80° C.) | | | |
|---|---|---|---|---|
| Example No. | Initial Viscosity (cSt) | Viscosity after 44 Days (cSt) | Change In Viscosity (cSt) (1) | Average Viscosity Increase %/Hour (2) |
| 1 | 1057.15 | 1504.45 | +447.3 | +0.040 |
| 2 | 999.0 | 1153.8 | +154.8 | +0.015 |

(1) (viscosity, 3 wks.) − (initial viscosity).
(2) [(change in viscosity)/(initial viscosity)] [100] /(504 hrs.)

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. Oil soluble additive, useful as a viscosity index improver-dispersant exhibiting improved antioxidant properties for lubricating oil compositions, comprising the reaction products of:

(a) an oil soluble ethylene copolymer comprising from about 15 to 90 wt. % ehylene and from about 10 to 85 wt. % of at least one $C_3$ to $C_{28}$ alpha-olefin, having a number average molecular weight of from about 20,000 to 500,000, grafted with an ethylenically unsaturated carboxylic acid material having 1 or 2 acid or anhydride moieties;

(b) organic polyamine having at least two primary amino groups;

(c) an aldehyde;

(d) a heterocyclic nitrogen reactant comprising at least one heterocyclic compound of the formula:

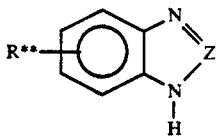

wherein Z is N, C(H) or C(R—*), and R—** is H, —OH, —Cl, —I, or —R—*, wherein R—* is $C_1$ to $C_{24}$ hydrocarbyl; and (e) a hydrocarbyl substituted dicarboxylic acid material.

2. The additive according to claim 1 wherein said hydrocarbyl substituted dicarboxylic acid material is a member selected from the group consisting of a polyalkenyl substituted succinic acid or succinic anhydride and $C_2$ to $C_{18}$ alkenyl-substituted succinic acid or anhydride.

3. The additive according to claim 2 wherein said hydrocarbyl dicarboxylic acid material comprises a polyalkenyl substituted succinic acid or anhydride wherein VIS said polyalkenyl group has a $\overline{M}_n$ of from about 400 to about 10, 000, and wherein said polyalkenyl is derived from at least one $C_2$ to $C_{18}$ monoolefin.

4. The additive according to claim 3 wherein said polyalkenyl group is poly($C_4$ alkenyl).

5. The additive according to claim 4 wherein said poly($C_4$ alkenyl) is polybutenyl.

6. The additive according to claim 2 wherein (e) has a functionality of at least about 1.3.

7. The additive according to claim 1 wherein the amount of (b) used is an amount effective to provide from about 0.5 to about 1.5 equivalents of primary amine per acid equivalent of the dicarboxylic acid material present in (a).

8. The additive according to claim 1 wherein said (a) comprises a copolymer consisting essentially of about 30 to 80 wt. % ethylene and about 20 to 70 wt. % propylene, having a number-average molecular weight in the range of about 20,000 to 200,000 grafted with maleic anhydride.

9. The additive according to claim 1 wherein (b) is a polyamine, said polyamine being an alkylene or oxyalkylene polyamine having at least two primary amine groups selected from the group consisting of alkylene polyamines having alkylene groups of about 2 to 7 carbon atoms and 2 to 11 nitrogens, and polyoxyalkylene polyamines, wherein the alkylene groups contain 2 to 7 carbon atoms and the number of oxyalkylene groups is about 3 to 70.

10. The additive according to claim 9 wherein said polyamine is diethylene triamine.

11. The additive according to claim 1 formed by simultaneously reacting (a), (b) and (e) with removal of water, to form a first adduct followed by reacting (c) and (d) therewith.

12. The additive according to claim 1 wherein said (b) and (e) are first prereacted, followed by reaction with said (a), and thereafter reacting (c) and (d) therewith.

13. The additive according to claim any of 1, 2 to 12 wherein Z is N.

14. The additive according to claim 13 wherein R** is H, —OH, —Cl, —I or $C_1$ to $C_3$ alkyl.

15. The additive according to claim 14 wherein said (c) comprises at least one of formaldehyde and paraformaldehyde.

16. The additive according to claim 15 wherein said (d) comprises at least one of benzotriazole and tolyltriazole.

17. An lubricating oil composition exhibiting improved antioxidant properties comprising a major proportion of oil selected from lubricating oil and fuel oil and a minor amount of a viscosity index improver-dispersant additive comprising the reaction products of (a) oil soluble ethylene copolymer comprising from about 15 to 90 wt. % ethylene and from about 10 to 85 wt. % of at least one $C_3$ to $C_{28}$ alphaolefin, having a number average molecular weight of from about 20,000 to 500,000, grafted with an ethylenically unsaturated mono-or dicarboxylic acid or anhydride;

(b) organic polyamine having at least two primary amino groups;

(c) an aldehyde;

(d) a heterocyclic nitrogen reactant comprising at least one heterocyclic compound of the formula:

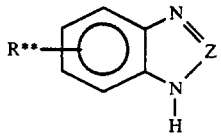

wherein Z is N, C(H) or C(R—*), and R—** is H, —OH, —Cl, —I, or —R—*, wherein R—* is $C_1$ to $C_{24}$ hydrocarbyl; and (e) a hydrocarbyl substituted dicarboxylic acid material.

18. The lubricating oil composition according to claim 17 which is a lubricating oil composition containing from about 0.01 to 15 wt. % of said additive.

19. The lubricating oil composition according to claim 17 which is a lubricating oil concentrate.

20. The lubricating oil composition according to claim 17 wherein (a) comprises a copolymer of about 30 to 80 wt. % ethylene and about 20 to 70 wt. % propylene, having a number-average molecular weight of about 20,000 to 200,00 grafted with maleic anhydride.

21. The lubricating oil composition according to claim 17 wherein (b) is a polyamine, said polyamine being an alkylene or oxyalkylene polyamine having at least two primary amine groups.

22. The lubricating oil composition according to claim 21 wherein wherein said alkylene polyamine contains alkylene groups of about 2 to 7 carbon atoms and 2 to 11 nitrogens.

23. The lubricating oil composition according to claim 22 wherein said alkylene polyamine is diethylene triamine.

24. The lubricating oil composition according to claim 21 wherein said oxyalkylene polyamine is a polyoxyalkylene polyamine wherein the alkylene groups contain 2 to 7 carbons, the number of oxyalkylene groups is from about 3 to 70, and the number of nitrogens is about 2 to 11.

25. The composition according to claim 17 wherein said hydrocarbyl substituted dicarboxylic acid material comprises a polyalkenyl substituted succinic acid or anhydride wherein polyalkenyl group is derived from at least one $C_2$ to $C_{18}$ monoolefin.

26. The lubricating oil composition according to claim 25 wherein said polyalkenyl has a $\overline{M}_n$ from about 400 to about 10,000.

27. The lubricating oil composition according to claim 26 wherein said polyalkenyl is polybutenyl.

28. The lubricating oil composition according to claim 25 wherein said polyalkenyl succinic anhydride has a functionality of at least about 1.3.

29. The lubricating oil composition according to claim 28 wherein (a) is comprised of an ethylene-propylene copolymer grafted with maleic anhydride, wherein (e) is comprised of polybutene succinic anhydride, and wherein the amount of (b) used is an amount effective to provide from about 0.5 to about 1.5 equivalents of primary amine per equivalent of acid of dicarboxylic acid material present in (a).

30. The lubricating oil composition as in any of claims 17 to 29 wherein Z is N.

31. The lubricating oil composition according to claim 30 wherein R** is —H, —OH, —Cl, —I or $C_1$ to $C_3$ alkyl.

32. The lubricating oil composition according to claim 31 wherein said (c) comprises formaldehyde or paraformaldehyde.

33. The lubricating oil composition according to claim 30 wherein said (d) comprises benzotriazole or tolyltriazole.

34. A process for preparing viscosity index improver-dispersant additive exhibiting improved low temperature viscometric properties comprising (i) grafting all soluble ethylene copolymer having a number average molecular weight of from about 20,000 to 500,000 and comprising about 15 to 90 wt. % ethylene and about 10 to 85 wt. % of at least one $C_3$ to $C_{28}$ olefin in an oil solution with at least one olefinically unsaturated dicarboxylic acid or anhydride using a free radical initiator at elevated temperatures; (ii) reacting with the grafted ethylene copolymer of at least one hydrocarbyl substituted dicarboxylic acid material to form a reaction mixture; (iii) reacting with said reaction mixture at least one polyamine containing at least two primary amino groups to form an amine-substituted grafted ethylene copolymer adduct having reactive amino groups, and (iv) reacting said adduct with at least one aldehyde and at least one heterocyclic nitrogen reactant comprising at least one heterocyclic compound of the formula:

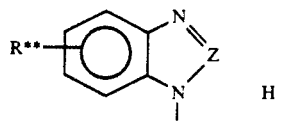

wherein Z is N, C(H) or C(R—*), and R—** is H, —OH, —Cl, —I, or —R—*, wherein R—* is $C_1$ to $C_{24}$ hydrocarbyl.

35. The process according to claim 34 wherein said ethylene copolymer is an ethylene-propylene copolymer having a number average molecular weight of from about 20,000 to 200,000 and comprises from about 30 to 80 wt. % ethylene and about 20 to 70 wt. % propylene.

36. The process according to claim 34 wherein said olefinically unsaturated dicarboxylic acid or anhydride is maleic acid or anhydride.

37. The process according to claim 34 wherein said polyamine is selected from alkylene polyamines and oxyalkylene polyamines.

38. The process according to claim 34 wherein said hydrocarbyl substituted dicarboxylic acid material is a succinic acid or anhydride.

39. The process according to claim 38 wherein said hydroxarbyl has a $\overline{M}_n$ of from about 400 to 10,000.

40. The process according to claim 39 wherein said hydrocarbyl is polyisobutenyl.

41. The process according to claim 39 wherein said polyisobutenyl succinic acid or anhydride has a functionality of at least about 1.3

42. The process according to claim 34 wherein Z is N.

43. The oleaginous composition according to claim 42 wherein R** is —H, —OH, —Cl, —I or $C_1$ to $C_3$ alkyl.

44. The oleaginous composition according to claim 43 wherein said (c) comprises formaldehyde or paraformaldehyde.

45. The oleaginous composition according to claim 44 wherein said (d) comprises benzotriazole or tolyltriazole.

* * * * *